United States Patent [19]

Sellers

[11] Patent Number: 4,661,684

[45] Date of Patent: Apr. 28, 1987

[54] ASPHALT HEATING SYSTEM

[76] Inventor: William W. Sellers, The Sellers Company, Inc., 396 E. Church Rd., King of Prussia, Pa. 19406

[21] Appl. No.: 951,339

[22] Filed: Oct. 16, 1978

[51] Int. Cl.[4] ..... H05B 1/02

[52] U.S. Cl. ..... 219/279; 219/486; 219/306; 219/282; 126/351; 222/146.2; 222/146.5

[58] Field of Search ..... 219/279, 282, 283, 306, 219/320, 321, 326, 485, 486, 312; 126/343.5 A, 351, 374, 352; 222/146.2, 146.5; 110/252; 340/577

[56] References Cited

U.S. PATENT DOCUMENTS

| | | | |
|---|---|---|---|
| 2,969,451 | 1/1961 | Logan | 219/279 X |
| 3,249,303 | 5/1966 | Townsend | 219/279 |
| 3,281,573 | 10/1966 | Hynes et al. | 219/320 X |
| 3,603,101 | 9/1971 | Sullivan | 219/326 |
| 3,622,748 | 11/1971 | Sellers | 219/321 |
| 3,681,566 | 8/1972 | Sellers | 219/321 |
| 3,804,154 | 4/1974 | Asdell et al. | 126/343.5 A |
| 3,838,813 | 10/1974 | Brosenius | 219/279 |
| 3,984,826 | 10/1976 | Kowalsky | 340/577 |
| 4,141,408 | 2/1979 | Garnett | 219/279 |

*Primary Examiner*—M. H. Paschall

[57] ABSTRACT

An asphalt heating system is comprised of a fuel fired, flue type tank heater, a heat transfer oil system for heating the oil circulated through the plant, and an electric booster heater for heating the oil and for use as a back-up heating means for the tank heater. Control means are provided for automatically activating the electric booster heater in the event of flame failure of the tank heater.

16 Claims, 7 Drawing Figures

ASPHALT HEATING SYSTEM

BACKGROUND AND SUMMARY OF THE INVENTION

In bituminous concrete plants, various components, other than storage tanks, are present, and require heating. For example, mixing tower components, piping pumps and pugmills must be maintained at relatively high temperatures for proper operation. Furthermore, these components are liable to freeze at shut down, and have to be heated in order to be put back into operation. It has been conventional practice to utilize a circulating heat-transfer fluid, usually oil, for the purpose of heating these various plant components. The oil is commonly circulated through one or more of the storage tanks in a plant in order to take advantage of the heat provided by the storage tank heaters and stored in the asphalt contained in the tanks.

The state of the art is illustrated by the heating systems disclosed in my prior U.S. Pat. Nos. 3,622,748 and 3,681,566 and in my pending application Ser. No. 859,878.

It is a general object of the invention to provide an improved heating system of the indicated type.

Briefly stated, the asphalt heating system of the invention is comprised of a fuel fired, flue type tank heater, a heat transfer oil system for heating the oil circulated through the asphalt plant, and an electric booster heater for heating the oil and for use as a back-up for the tank heater. Control means are provided for automatically activating the electric booster heater in the event of flame failure of the tank heater.

The heating system of the invention combines the economy of fuel fired equipment with the reliability and overall efficiency that can be achieved with electric heating means. As will be described more fully hereinafter, the combination heating system of the invention including an electric booster back-up heater which is interlocked with the plant to take advantage of the lowest cost kilowatt hour charges has the following advantages:

1. It eliminates the need of overheating the asphalt in storage in order to maintain the desired temperature of the heat transfer oil.

2. It provides the ability to raise the heat transfer oil to, or above, the temperature of the asphalt in storage for heating other coiled tanks or as a back-up for heating asphalt in storage in the event of failure of the fuel fired heater.

3. It permits the heating of the heat transfer oil if there is no asphalt in the tank which allows for use of the residual in the tank in the case of an emergency.

4. It reduces the time required for heating from a cold start, thus reducing the overall consumption of energy.

5. It provides an automatic back-up of the oil heat transfer system used to heat plants in the event that the fuel fired heater fails to start.

6. It provides automatic back-up of the tank heating system to heat asphalt in storage in the event the fuel fired heater fails to start.

DETAILED DESCRIPTION OF THE PREFERRED EMBODIMENTS

Figure 1:
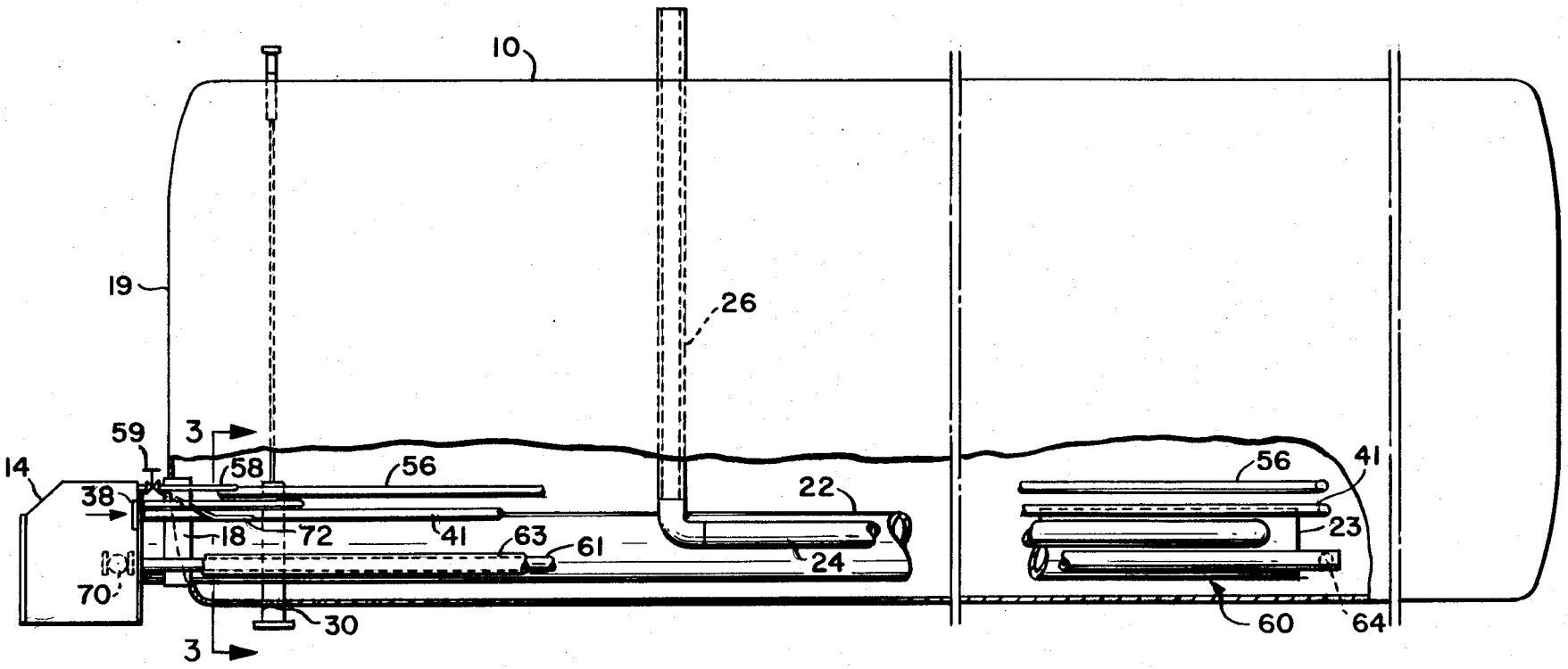
FIG. 1 is a partially cut-away side elevation of an asphalt storage tank having the heating system in accordance with the invention.
Figure 2:
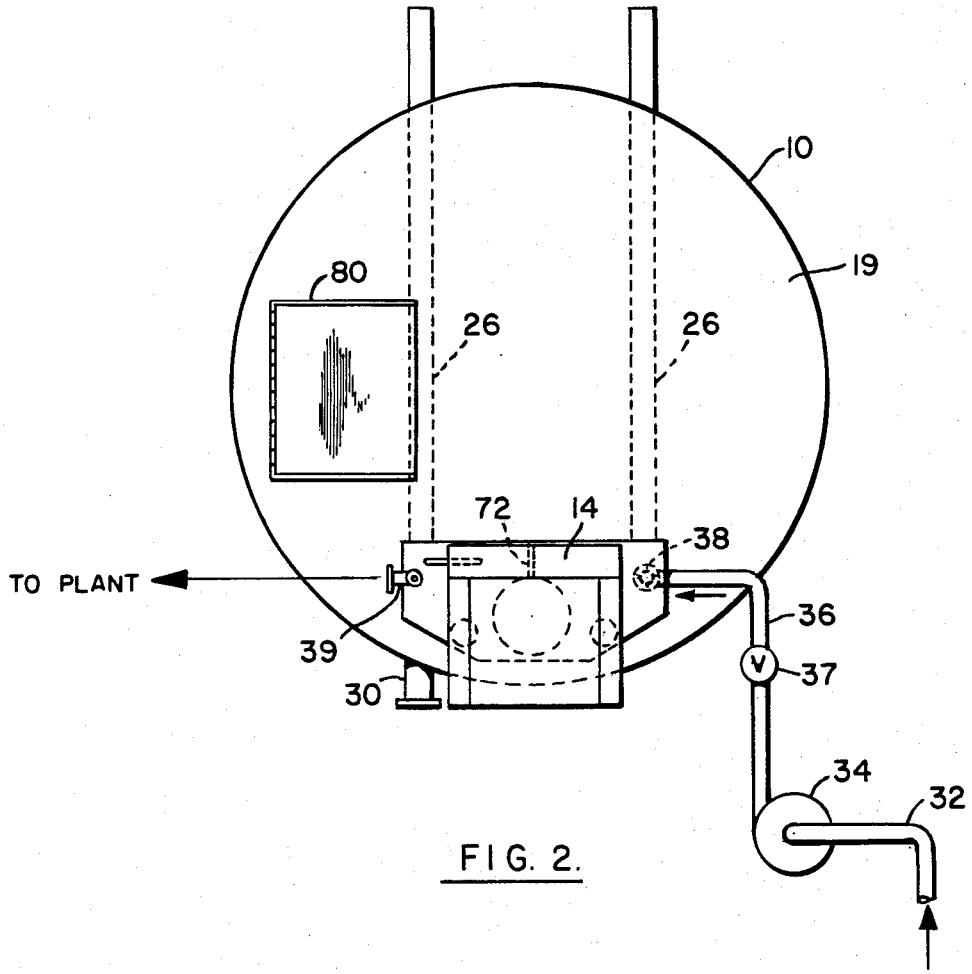
FIG. 2 is a front elevation of the tank shown in FIG. 1.
Figure 3:
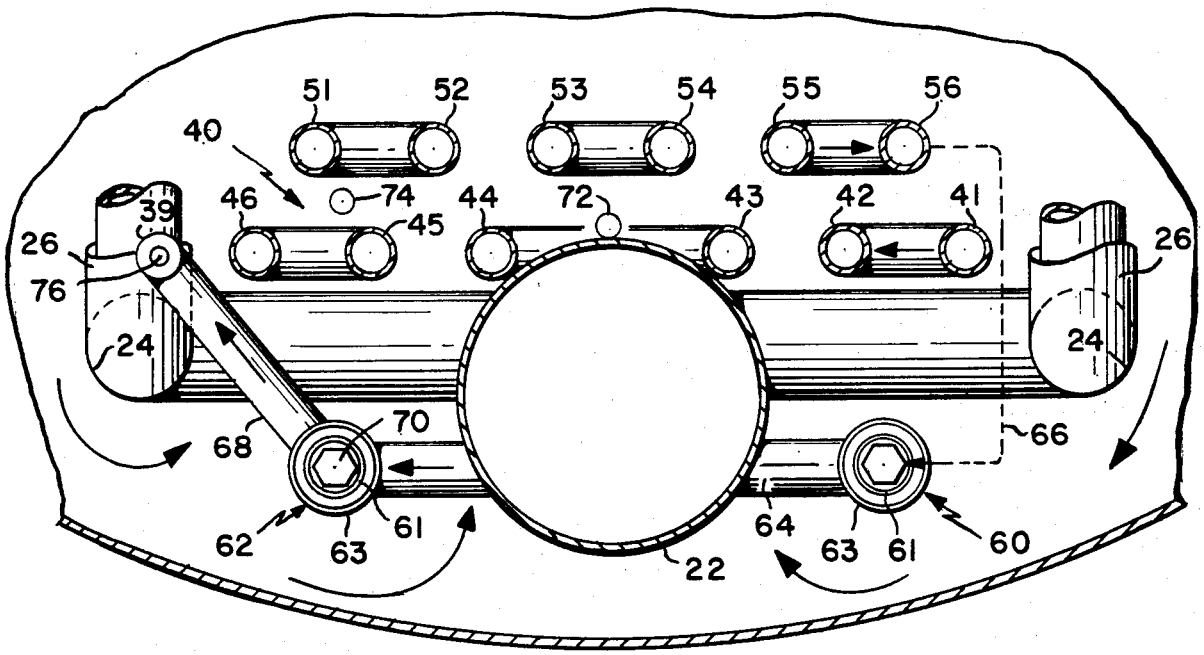
FIG. 3 is a sectional view taken on line 3—3 of FIG. 1.

In the form of the heating system of the invention shown in FIGS. 1–3 there is provided a flue fired heating means which is preferably a tank heater of the type shown in my pending application Ser. No. 859,878. The tank heater extends horizontally along the bottom of an insulated storage tank 10 and includes an oil fired burner assembly contained in a weatherproof burner housing 14. Preferably, the burner assembly is similar to a conventional domestic oil burner and includes a blower for delivering ignited fuel at a substantial velocity through a discharge orifice into a combustion chamber adjacent the discharge orifice. The discharge orifice extends through a tankhead adapter plate 18 of insulating material in the tankhead 19 of tank 10. The combustion chamber extends a substantial distance from plate 18 into a primary heat transfer tube 22 which is of a cylindrical construction and extends horizontally along the bottom of tank 10. Heat transfer tube 22 receives heating gases from the combustion chamber and directs them along the bottom of tank 10 for heating the contents thereof.

The tank heater includes a pair of secondary heat transfer tubes 24 which extend from the end 23 of primary heat transfer tube 22 toward the tankhead 19 in spaced parallel relation with respect to the tube 22. Tubes 24 terminate at vertical stacks 26 which extend upwardly through the top of tank 10. Secondary heat transfer tubes 24 direct heating gases from end 23 of primary heat transfer tube 22 in a direction along the bottom of tank 10 to the vertical stacks 26 in which the gases go upwardly to the exterior of tank 10.

In the operation of the tank heater, the burner assembly delivers ignited fuel at a substantial velocity through the discharge orifice and into the combustion chamber whereat the fuel burns. Heating gases flow horizontally from the combustion chamber through primary heat transfer tube 22 to end 23 from which the heating gases flow horizontally through secondary heat transfer tubes 24 and upwardly through stacks 26 to the exterior of tank 10. The tubes 22 and 24 transfer heat to the contents of the tank to maintain a desired temperature of these contents by the use of appropriate temperature controls.

The fuel fired heating means described above serves to heat the contents of storage tank 10 and deliver heat to these tank contents (asphalt in the case of an asphalt heating plant) in a heating zone extending along the tank bottom and concentrated in a zone surrounding heat transfer tube 22 and tubes 24 a certain extent. Asphalt heated in this zone will rise vertically, cooler asphalt will flow down the sides of tank 10 outside this zone to the heating area providing convection circulation. The asphalt in this lower region will be at a higher temperature and in a more fluid state than the asphalt on the tank sides. The storage tank heater will maintain the asphalt in this lower region in a fluid state sufficient to permit flow thereof to the asphalt plant. As is conventional in an asphalt heating system, the asphalt in storage tank 10 is delivered to the asphalt plant by way of a drain line connected to a safety suction 30 in tank 10.

The asphalt plant utilizes heated oil for various purposes, such as the heating of jacketed components of the plant that could freeze during a plant shutdown. The heated oil supplies the required heat to these auxiliary components by circulating through the jackets therefor. The heat transfer oil is circulated through storage tank 10 by a conduit means in accordance with the invention.

Referring to FIG. 2, it is noted that after utilization by the plant, the heat transfer oil is delivered by a return line 32 to a pump 34 which pumps the oil into storage tank 10 through a line 36 having a control valve 37 therein and connected to a tank inlet 38. After passing through the conduit means within storage tank 10, the heated oil flows outwardly through an outlet 39 which is provided with a flange for connection to piping leading to the auxiliary components of the asphalt plant.

The heating system of the invention comprises a conduit means providing a flow path within storage tank 10 for conducting the flow of heat transfer fluid (oil) through the interior of storage tank 10, the conduit means being constructed and arranged to extend within the heating zone around the tank heater in close proximity to and in heat exchange relationship therewith. To this end, there is provided a scavenger coil 40 adapted to receive the oil from tank inlet 38 and located within the confines of the tubes 24 and just above the tube 22 as is shown in FIG. 3.

Scavenger coil 40 comprises a lower layer having three coil loops and an upper layer also having three coil loops. The lower layer of scavenger coil 40 comprises six horizontally extending pipes 41, 42, 43, 44, 45 and 46, joined by elbow connections at appropriate ends. Pipes 41 and 42, pipes 43 and 44, and pipes 45 and 46 are connected by crossover elbows at the rear end of tank 10 as is shown in FIG. 3. Pipes 42 and 43, and pipes 44 and 45 are connected by crossover elbows at the head end of tank 10. Pipe 41 is connected to receive the flow of oil from tank inlet 38. By this arrangement, oil is conducted through the coil loops of the lower coil layer of scavenger coil 40 sequentially through pipes 41, 42, 43, 44, 45 and 46.

The upper coil layer of scavenger coil 40 comprises six horizontally extending pipes 51, 52, 53, 54, 55 and 56 joined by elbow connections at appropriate ends. Pipe 46 is connected to the upper coil layer by an elbow at the head end of tank 10 extending at about a 45° angle between pipe 46 and pipe 51 to deliver oil from the lower coil layer to the upper coil layer. Pipes 51 and 52, pipes 53 and 54, and pipes 55 and 56 are connected by crossover elbows at the rear end of tank 10 as is shown in FIG. 3. Pipes 52 and 53, and pipes 54 and 55 are connected by crossover elbows at the head end of tank 10. By this arrangement, oil is conducted to flow through the upper layer of scavenger coil 40 sequentially through pipes 51, 52, 53, 54, 55 and 56.

In accordance with the invention there is provided an electric booster heater for delivering heat to the oil in addition to the heat the oil receives from the contents of the tank as the oil passes through the scavenger coil 40. To this end, there is provided a conduit means including a pair of elongated conduits 60 and 62 extending horizontally along the bottom of tank 10. Conduits 60 and 62 are located on opposite sides of tube 22 and below tubes 24 as is shown in FIG. 3. Conduits 60 and 62 each comprise an inner tube 61 and an outer tube 63 arranged concentrically. Inner tubes 61 are closed off at their rear ends and extend from the interior of tank 10 through block 18 into the interior of housing 14. A crossover pipe 64 is arranged to provide flow communication between the rear ends of outer pipes 63 of conduits 60 and 62. At the head end of tank 10 pipe 56 is connected to the outer pipe 63 of conduit 60 by a conduit indicated in dash lines at 66, and the outer pipe 63 of conduit 62 is connected to the tank outlet 39 by a conduit 68.

By this arrangement, oil is conducted to flow sequentially from pipe 56 of scavenger coil 40 through conduit 66, the annular passage between pipes 61 and 63 of conduit 60, crossover pipe 64, the annular passage between pipes 61 and 63 of conduit 62, and pipe 68 to tank outlet 39.

In accordance with the invention, electric heating means is arranged to extend within conduits 60 and 62 for applying heat directly to the oil passing therethrough. To this end, electric heating elements 70 are positioned within the inner tubes 61 of conduits 60 and 62. Preferably, heating elements 70 are of the type described in U.S. Pat. No. 3,045,097. Heating elements 70 extend from the interior of housing 40 throughout the longitudinal extent of conduits 60 and 62. As will be described hereafter, heating elements 70 are thermostatically controlled to serve as an oil heating means in addition to the tank heater which operates as an oil heating means by heating the asphalt in storage in the zone surrounding scavenger coil 40.

A feature of the two layer arrangement of scavenger coil 40 is in accordance with the invention is that it is constructed to prevent formation of air pockets in the oil circulating system. Also, water vapor in the form of steam can also form in the system. Scavenger coil 40 is constructed and arranged so that the oil entering the system flows progressively horizontally and then upwardly to a location where air and water vapor can be vented off before the oil is permitted to flow downwardly to the electric booster heater conduits 60 and 62. The prevention of the formation of air pockets in scavenger coil 40 insures that the electric booster heater conduits 60 and 62 will be flooded with oil at all times thereby preventing the possibility of a overheating condition in the electric booster heater.

In another flow circuit of the indicated type, oil pockets do develop and once they are formed, it is difficult to remove the air from the system. In scavenger coil 40 of the invention, there is provided a vent line 58 extending from pipe 56 in the upper coil layer through plate 18 to the exterior of tank 10. Vent line 58 has a control valve 59 connected therein for controlling the bleeding of air and water vapor from the system. By locating vent line 58 in the upper layer of scavenger coil 40, this vent line is located at the highest point of scavenger coil 40 which is the best place to drain off air and water vapor.

The asphalt heating system of the invention is thermostatically controlled to maintain desired temperature conditions of the asphalt and the heat transfer oil. To this end, there are provided three thermowells 72, 74 and 76, the location of which is important. Thermowells 72, 74 and 76 each have thermostatic elements installed therein constructed to control circuitry of the type shown in FIG. 4 for actuating various control elements as will be described hereafter.

Thermowell 72 is arranged to sense the temperature of tube 22 of the fuel fired tank heater. To this end, thermowell 72 extends from the exterior of tank 10 through plate 18 into contact with and along the top of tube 22. The arrangement of thermowell 72 in direct contact with tube 22 is important since it is the surface temperature of tube 22 that is to be measured and used to control the asphalt tank heater because it is the surface of tube 22 that is in contact with the asphalt. In the operation of the tank heater it is important that the tube surface temperature does not exceed preset limits. The temperature controller that has its sensing element in thermowell 72 is not necessary for the functioning of the system but is a beneficial safety feature. If asphalt has been drained below the top of the primary flue and the fuel fired heater is permitted to operate, the asphalt temperature controller sensing element in thermowell 74 will not respond soon enough to prevent the primary flue from becoming excessively hot; also, since it is very easy for field personnel to increase the fuel pressure or increase the orifice size of the burner, they can perhaps, unknowingly, over-fire the flue, creating excessively high temperature on the surface in contact with asphalt. By monitoring the surface temperature of the asphalt heating primary flue, a very damaging over-temperature situation can be avoided.

Thermowell 74 is arranged to sense the temperature of the asphalt for controlling an asphalt heat temperature controller, the location of thermowell 74 being very important. To this end, thermowell 74 is constructed and arranged to extend horizontally within the confines of scavenger coil 40 and between the upper and lower coil layers of scavenger coil 40. This location of thermowell 74 overcomes the problem of congealing of asphalt around tube 22 that could occur when the asphalt plant is started up and cold oil is circulated through scavenger coil 40. This cold circulating oil "sucks out" or absorbs heat from the asphalt around tube 22 and could cause congealing of the asphalt in this area. By locating thermowell 74 within the confines of scavenger coil 40 as described above, thermowell 74 permits sensing that heat is being absorbed from the asphalt in this region (as when cold oil is circulated through scavenger coil 40) whereby the asphalt heater temperature controller can be actuated when necessary to turn on the fuel fired tank heater. With the tank heater in operation, the asphalt in the bottom of tank 10 is heated and induces a circulating flow of the asphalt to bring a fresh supply of hot asphalt into the region involved. This circulating asphalt flow is shown by the arrows in FIG. 3. This hot asphalt prevents congealing around the surface of tube 22 and insures an efficient rate of heat transfer through tube 22 to the asphalt and from the asphalt to the heat transfer oil being circulated through scavenger coil 40.

Thremowell 76 is arranged to sense the temperature of the oil for controlling an oil heat temperature controller which controls operation of electric heaters 70. To this end, thermowell 76 is arranged to extend within the tank oil outlet 39.

The controls for the electric booste back-up heater and other parts of the asphalt heating system in accordance with the invention are contained in a cabinet 80 mounted on tankhead 19. The control circuitry pertinent to the present invention is shown schematically in FIG. 4. This circuitry comprises three phase power brought to lines 84, 85 and 86 through a suitable disconnect switch or breaker not shown. Lines 84, 85 and 86 feed power through appropriate fusing to the normally open contacts of the oil circulating pump motor starter M-1, the normally open contacts of the electric booster heater contactors, C-1 and C-2, and the control circuit transformer 100 (if low voltage for control circuit is not supplied by a separate source).

Figure 4:
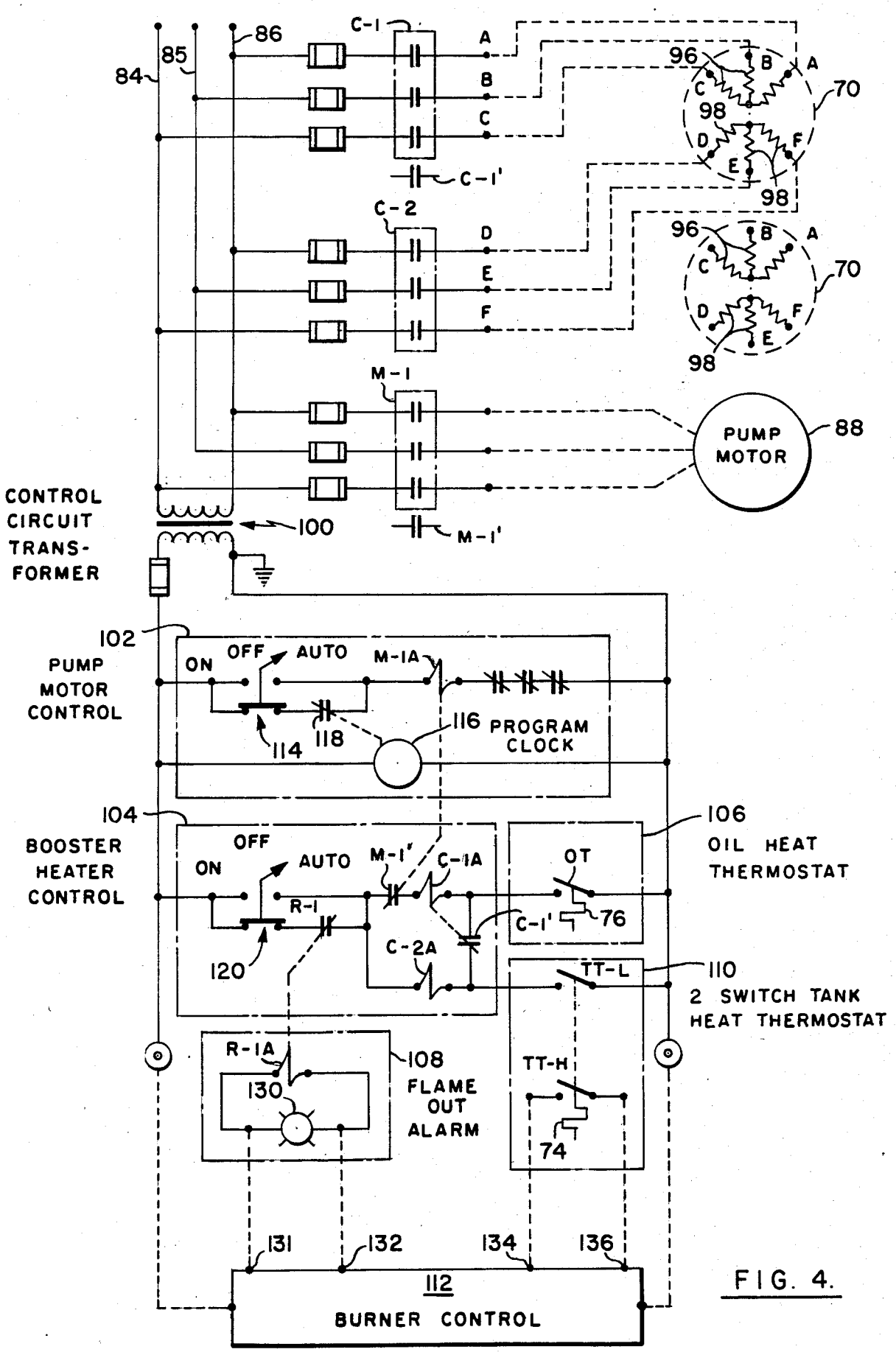
FIG. 4 is a schematic diagram of electric control circuitry utilized in the heating system in accordance with the invention.

The "downstream" side of the motor starter M-1 contacts are connected to the oil circulating pump motor 88. The "downstream" side of contactor C-1, contacts A, B and C, are connected to one set of "Star" connected coils 96 in each of the heating elements 70. The "downstream" side of contactor C-2, contacts D, E and F, are connected to the second set of "Star" connected coils 98 in each of the heating elements 70. The wiring of lines 84, 85 and 86 to the second element 70 in FIG. 4 is not shown for the sake of clarity. Motor starter M-1, contactors C-1 and C-2, are actuated by solenoid coils M-1A, C-1A and C-2A, respectively, and energized as will be described hereafter.

Power supply lines 84 and 86 are connected to the primary winding of a control circuit transformer 100, the secondary winding of which supplies power to various controls including a pump motor control 102, a booster heater control 104, and oil heat thermostat 106, a flame-out alarm 108, a two switch tank heat thermostat 110 and a burner control 112.

Pump motor control 102 comprises a three-position selector switch 114, a program clock 116 and an associated switch 118 and coil actuator M-1A, all connected as shown in FIG. 4.

Booster heater control 104 comprises a three-position selector switch 120, solenoid relay contact R-1, motor starter contact M-1', coil actuators C-1A and C-2A, contactor contact C-1' and an oil temperature controller switch OT, all connected as shown in FIG. 4.

Oil heat thermostat 106 comprises a switch OT which is actuated between open and closed positions by the temperature sensing element contained in thermowell 76.

Flame-out alarm 108 comprises a light 130 and a coil actuator R-1A of relay R-1 connected in parallel and to terminals 131 and 132 of burner control 112.

Tank heat thermostat 110 comprises a switch TT-L connected to terminals 134 and 136 of booster heater control circuit 104 and switch TT-H connected to terminals of the burner control 112. Switches TT-L and TT-H are actuated between opened and closed positions by the thermostatic control element contained within thermowell 74.

The terminals 131 and 132 of burner control 112 connected to light 130 and coil actuator R-1A are connected to a switch actuated by a flame sensing device which determines whether or not there is a flame in the fuel fired tank heater, the operation of which will be described hereafter. The terminals 134 and 136 of burner control 112 connected to the switch TT-H are also connected in the circuit containing the switch controlled by the flame sensing device.

As is shown in FIG. 4, the set of contacts C-1, which control the supply of current to a set of coils 96 in each of the electric heating elements 70, can only operate if contact actuator M-1A is energized in which event contacts M-1' and the set of contacts M-1 are closed causing pump motor 88 to run. On the other hand, the set of contacts C-2, which control the supply of current to a set of heating coils 98 in each of the electric heaters 70, can operate even though the pump motor 88 is not running. Moreover, contact actuator C-2 will automatically be energized if contact actuator C-1A is energized. The switch OT of thermostat 106 and the switches TT-L and TT-H of thermostat 110 ar normally closed and open when temperature reaches set point. The over-temperature thermostat with its sensing bulb in thermowell 72 is not shown in wiring diagrams as while it is desirable, it is not essential to the invention.

Oil heat thermostat 106 is operated in response to the sensing of the heat transfer oil temperature at thermowell 76. The tank heat thermostat 110 is a two stage thermostat operated in response to the sensing of the temperature of the asphalt in the tank at thermowell 74. In FIG. 4 the low set hand of the thermostat 110 regulates the temperature at which the switch TT-L will open; the high set hand of the thermostat 110 regulates the temperature at which the switch TT-H will open.

In normal operation, the asphalt in tank 10 is maintained at a desired temperature by operating the fuel fired heating equipment using switch TT-H to start and stop the burner as heat is required.

Selector switch 114 is used to control operation of the pump motor 88 only and can be positioned to an "ON", and "OFF", or an automatic position. In the automatic position of selector switch 114, the oil circulating pump motor 88 is controlled completely by the switch 118 of the 7-day program clock 116.

Burner control 112 has a control circuit connected to terminals 131 and 132 and including a contact that is closed when the burner fails to light under conditions when the circuit is energized calling for ignition. This contact is used to light a red light 130 (and/or to blow a horn) and to energize actuator R-1A.

Selector switch 120 controls the electric booster heater and can be set in an "ON", and "OFF", or an automatic position. In the automatic position of switch 120 power can flow to the coil actuators C-1A and C-2A in the event that contacts R-1 are actuated to the closed position by actuator R-1A which occurs during a flame failure situation.

In order for actuator C-1A to be energized, the temperature of the oil must be below the temperature setting for the oil heat thermostat switch TO (whereby this switch is closed) and the oil circulating pump motor 88 must be operating whereby switch contact M-1′ is closed. If actuator C-1A is energized, a separate contact C-1′ will close to energize actuator C-2A allowing the heaters 70 to operate at full capacity with both coils 96 and 98 being energized.

If the oil temperature is above the thermostat setting (whereby switch TO is open) or if the oil circulating pump motor 88 is not operating (whereby contact M-1′ is open) and actuator R-1A is energized and selector switch 120 is in the automatic position, actuator C-2A would be controlled by the low switch setting of the tank heat thermostat at switch TT-L permitting each heater 70 to operate on one set of coils 98 only. The circuit is constructed so that with one set of coils 98 of each heater 70 in operation, there will be applied a low heat density suitable for heating the tank 10 even when there is no oil circulation. This type of operation where a low heat input is used when oil is not flowing is described more fu11y in my U.S. Pat. No. 3,681,566.

As is apparent from the above description, the electric back-up booster is used as a heating means serving as a back-up for both the oil heat transfer system which is used to heat the piping in the plant and for maintaining the asphalt at a pre-set minimum temperature in the event a flame out condition should occur.

It will thus be apparent that there is provided a control means which is responsive to a flame out condition of the fuel fired heating means to turn on the electric booster heater for the oil, which serves to supply the necessary heat for heating the components external to the tank. This control means also turns on a suitable alarm in the form of a light (and/or a horn) to inform the operator of the condition of flame out of the fuel fired heating means.

There is also provided a control means which is responsive to the occurrence of a desired temperature below that temperature of the asphalt desired which is operable, when this temperature is reached, to turn on the low density heat input portion of the booster heater. By turning on the low density heat input portion of the booster heater, this control can operate whether or not the pump is circulating oil. The reason that the low density heating phase is used is that a flame out or an asphalt temperature drop might occur when no oil is flowing and it is necessary that oil be flowing to operate at the high density level.

It should also be noted that integral with the burner control is an ON/Off switch not shown. With the booster heater selector switch 120 in the ON position and the burner turned off, the booster heater can be used to heat the tank and the oil circulating system without first having to have a flame failure. Also, with the booster heater selector switch 120 in the ON position and the burner switch in the ON position, the booster heater can assist the burner in heating up the tank as may be desirable upon receipt of a cold load of asphalt.

An advantage of the arrangement shown in FIG. 3 wherein the oil heating conduits 60 and 62 are located below scavenger coil 40 and near the bottom of tank 10 is that it permits the level of the asphalt to fall to a very low level without damage to the equipment. It is noted that the oil heating elements 70 heat both the oil and the asphalt, and with any heating element in an asphalt tank it is necessary to have the liquid cover the heating surface to prevent overheating and damage to the equipment. The arrangement shown in FIG. 3 permits a low level asphalt to be heated electrically and also permits heating of oil without asphalt in tank 10.

An advantage of the combination heating system of the invention is the conservation of energy. In the prior art it is customary to maintain the asphalt at a temperature high enough for plant operation and to provide a satisfactory temperature differential for heating the heat transfer oil to a minmum satisfactory level. With the addition of the electric booster heater in the combination of the invention it is possible to use the electric booster heater to maintain the heat transfer oil temperature without overheating the asphalt to maintain the oil.

Another feature of the invention is that it increases the capacity of the unit to heat things external of the tank that could not be heated satisfactorily by a system without the booster heater. For example, it is possible to heat another asphalt tank at or near the same temperature as the tank with the combination heating unit installed therein.

Another feature of the invention is the reduction in the long period of preheat time required for heating the heat transfer oil as compared with prior art system. With the arrangement of the invention these preheat periods can be drastically reduced by utilizing the electric booster heater.

It should also be noted that the relationship of the scavenger coil to the electric booster is significant. By allowing oil to flow through the scavenger coil before flowing through the electric booster heater, the lower temperature heat transfer oil can absorb more energy from the asphalt and the electric booster heater can raise the heat transfer oil to or above the temperature of the asphalt in the storage tank.

Thus, the arrangement of the invention combines the economy of fuel fired equipment with the reliability and overall efficiency (lower cost of operation) that can be achieved with electric heat.

While fuel fired, the tank heating and oil heating described here is with the use of a flue tube type tank heater and a scavenger coil, the "Electric Back-Up Booster" would be just as applicable to a fuel fired combination tank heater and oil heater where the primary flue is jacketed and oil is circulated through the jacket between the flue containing the hot gases and outer jacket next to the asphalt.

It is also evident that the invention applies to all types of fuel fired burning equipment—gas, oil and powdered fuels.

Figure 5:
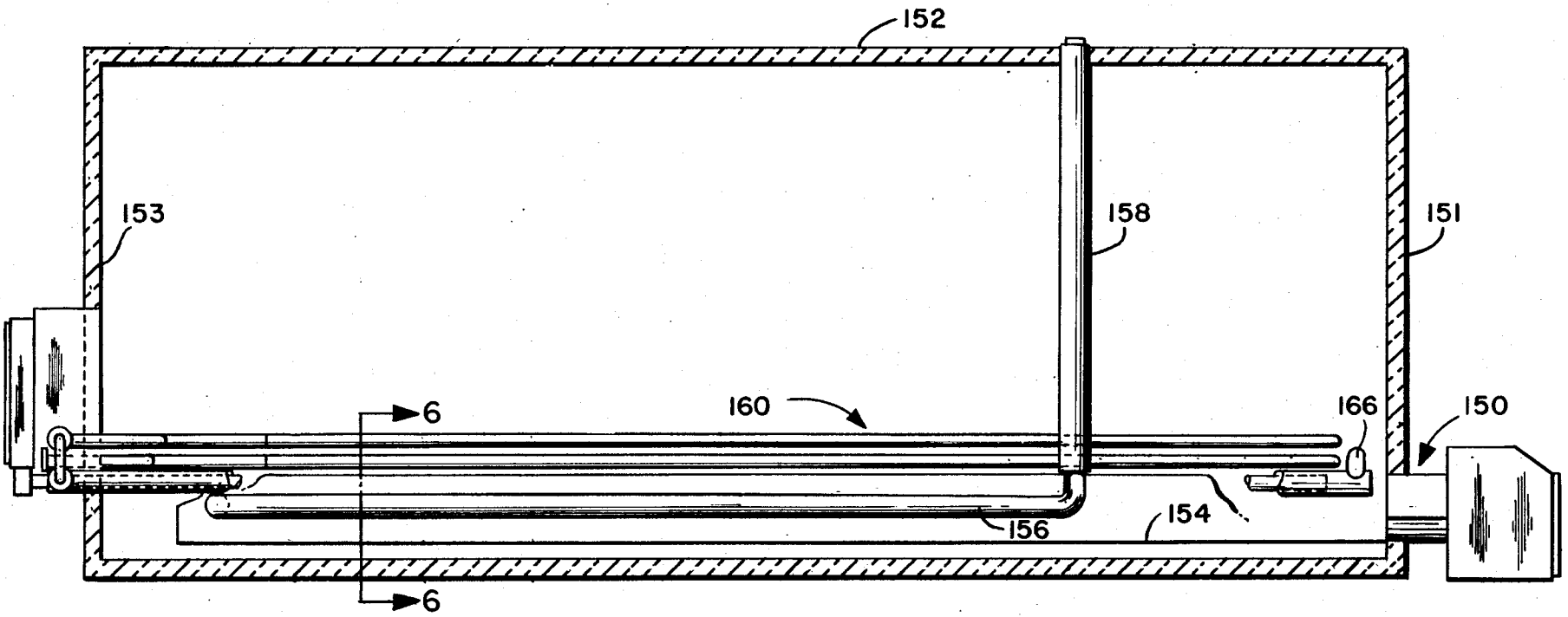
FIG. 5 is a sectional view, in elevation, of another asphalt heating system in accordance with the invention.
Figure 6:
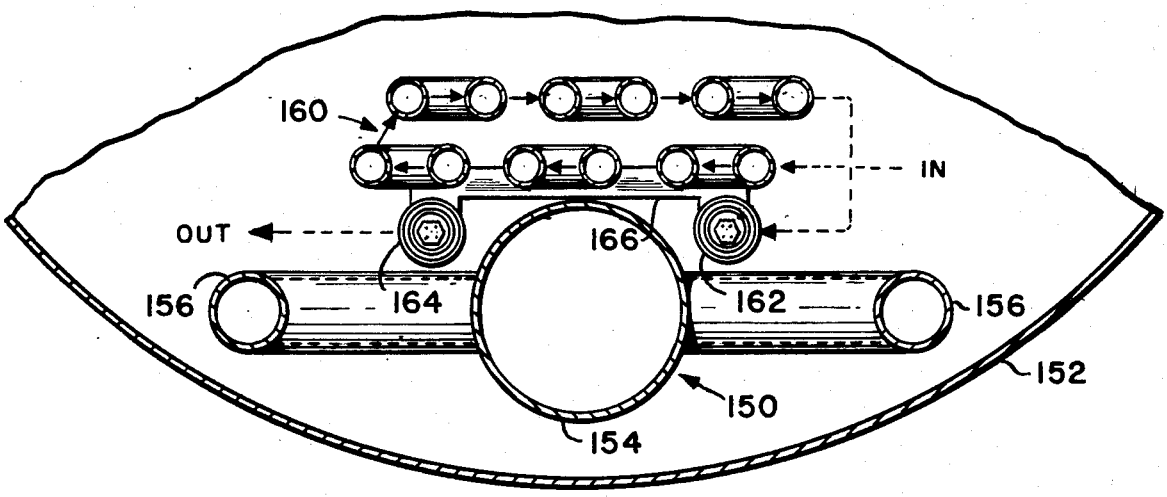
FIG. 6 is a sectional view taken on the line 6—6 of FIG. 5.

In FIGS. 5 and 6, there is shown an asphalt heating system in accordance with the invention illustrating how an existing fuel fired tank heating means may have oil heating equipment added thereto in order to perform in accordance with the invention. To this end, an oil fired tank heater 150 similar to that shown in FIGS. 1 to 3 extends into a storage tank 152 from its one end 151 and along the bottom thereof and comprises a primary heat transfer tube 154 and a pair of secondary heat transfer tubes 156 terminating in vertical stacks 158. There is also provided a unit comprising a scavenger coil 160 and an elongated booster heater including electrically heated conduits 162 and 164 arranged to extend into tank 152 from its other end 153 as is apparent from FIG. 5. The scavenger coil 160 is constructed similar to the scavenger coil of the embodiments shown in FIGS. 1 to 3 and comprises two layers of coils with the oil flowing from the lower layer to the upper layer, from which the oil flows downwardly to conduit 162 and then through a crossover conduit 166 to the conduit 164 from which the oil is discharged from tank 152, the oil flow being shown by the arrow lines in FIG. 6.

Thus, the arrangement shown in FIGS. 5 and 6 is essentially the same as that shown in FIGS. 1 to 3. The main difference is that the fuel fired heater and the oil heating means are arranged to extend into the tank 152 from opposite ends thereof. This design permits the addition of an oil heating unit into an existing storage tank already provided with a fuel fired tank heater.

Figure 7:
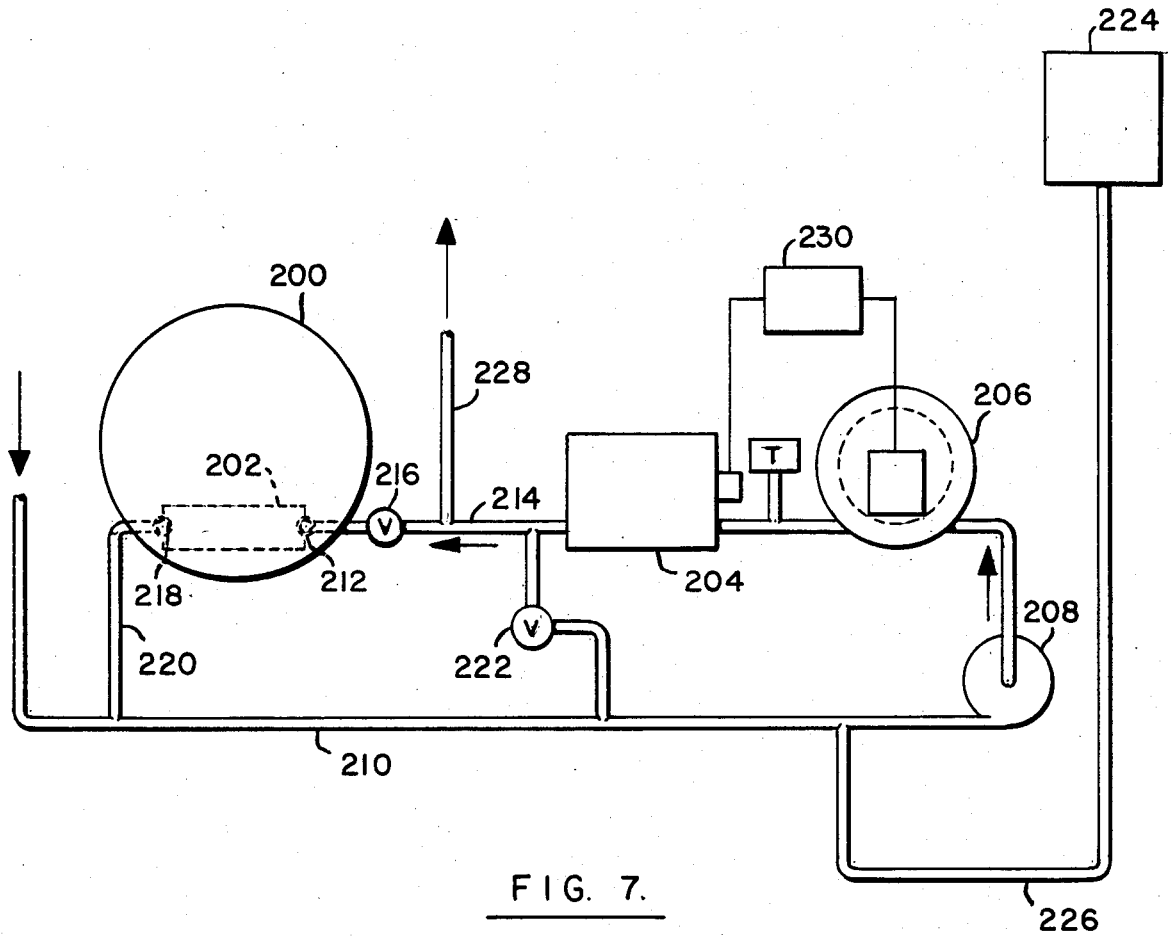
FIG. 7 is a schematic view of another asphalt heating system in accordance with the invention.

It is noted that the control means described herein and shown in detail in FIG. 4 is applicable to an asphalt heating system in which the fuel fired heating means is external to the storage tank. Such a system is shown schematically in FIG. 7 and comprises a storage tank 200 containing a scavenger coil 202, as well as an electric heater 204 and a fuel fired heater 206 both of which are external to storage tank 200. The heat transfer oil is circulated through the storage tank 200 and the external heaters 204 and 206 by means of a pump 208. Oil is delivered to pump 208 by way of a return line 210 from the plant components and pump 208 delivers the oil to the fuel fired heater 206 whereat the oil is heated by a suitable heat transfer arrangement such as a coil design. The oil passes from heater 206 to the electric heater 204 which is arranged to heat the oil electrically by a suitable heat transfer arrangement before it is delivered to the tank inlet 212 by way of an inlet line 214 containing an inlet valve 216. After passing through the scavenger coil 202 within storage tank 200, the oil flows outwardly through an outlet 218 and a line 220 back to the return line 210. A suitable relief valve 222 is connected between the tank inlet line 214 and the return line 210. Return line 210 is connected to an expansion tank 224 by a line 226. Oil is supplied to the tank components by a line 228 extending upwardly from the inlet line 214.

Control means such as those shown in FIG. 4 are provided to be responsive to a flame-out condition of the fuel fired heater 206 to turn on the electric heater 204 to heat the heat transfer oil. The control means is indicated at 230 and comprises suitable control elements for sensing the flame-out condition and for energizing the electric heater 204 when the flame-out condition occurs, such as the elements shown in FIG. 4. In this manner, the electric heater 204 serves as a backup heater in the event a flame-out condition occurs in the fuel fire heater 206.

I claim:

1. Apparatus for heating a fluid in storage such as asphalt or similar fluids that are viscous or solid under heated conditions and a circulating heat transfer fluid comprising:

a storage tank;

a fuel fired heating means mounted to extend horizontally a substantial distance within said tank for delivering heat to a heating zone within said tank for heating the fluid in storage;

a heat transfer fluid;

and a conduit means providing for the recirculating flow of said heat transfer fluid, said conduit means including a flow path within said storage tank for conducting the flow of the heat transfer fluid to the interior of said storage tank;

said flow path of said conduit means being constructed and arranged to extend with said heating zone in close proximity to and in heat exchange relationship with said fuel fired heating means;

the improvement comprising electric heating means constructed and arranged to heat the heat transfer fluid for maintaining a desired temperature thereof, said conduit means including an elongated portion within said tank and said electric heating means being arranged to extend within said elongated portion of said conduit means, said conduit means including a scavenger coil portion including a plurality of loops extending into the heating zone some portion of which is above the fuel fired heating means, said fuel fired heating means being located near the bottom of said tank with said elongated conduit portion being located with an elongated conduit on each side of fuel fired heating means at the bottom of the tank with said scavenger coil being located above both said fuel fired heater and said electric heating means.

2. Apparatus according to claim 1 wherein said conduit means includes a pair of spaced elongated portions and a crossover portion joining said elongated portions, said electric heating means comprising electric heating units arranged to extend within said elongated portions.

3. Apparatus according to claim 2 wherein said elongated portions of said conduit means comprise an inner pipe and an outer pipe, the heat transfer fluid being arranged to flow in the space between said inner and outer pipes, said electric heating means being located within said inner pipe.

4. Apparatus according to claim 1 including means for directing the flow of heat transfer fluid to flow into said lower layer of loops, from said lower layer of loops to said upper layer of loops, from said upper loop to said elongated conduit portion containing said electric heating means and out of said storage tank.

5. Apparatus according to claim 4 including means for venting air from said upper layer of loops.

6. Apparatus according to claim 1 wherein said fuel fired heating means includes a primary heat transfer tube extending horizontally along the bottom of said tank, and comprising means for sensing the temperature of said tube at a location approximate to the combustion chamber including a thermowell extending along the surface of said tube in contact therewith at said location.

7. Apparatus according to claim 1 including pump means for circulating heat transfer fluid through said conduit means, and first control means including means sensing a flame out condition of said fuel fired heating means to turn on said electric heating means to heat the heat transfer fluid.

8. Apparatus according to claim 7 wherein said first control means provides an alarm signal of said flame out condition.

9. Apparatus according to claim 7 including second control means responsive to a preset temperature condition of the tank contents to turn on said electric heating means.

10. Apparatus according to claim 7 wherein said electric heating means includes a low density heat input portion and a high density heat input portion.

11. Apparatus according to claim 1 wherein said conduit means and said electric heating means are constructed and arranged to extend into said storage tank from one end thereof and said fuel fired heating means is constructed and arranged to extend into said storage tank from the opposite end thereof.

12. Apparatus for heating a fluid in storage such as asphalt or similar fluids that are viscous or solid under unheated conditions and a circulating heat transfer fluid comprising:

a storage tank;

a fuel fired heating means mounted to extend horizontally a substantial distance within said tank for delivering heat to a heating zone within said tank for heating the fluid in storage;

a heat transfer fluid;

and a conduit means providing for the recirculating flow of said heat transfer fluid, said conduit means including a flow path within said storage tank for conducting the flow of the heat transfer fluid to the interior of said storage tank;

said flow path of said conduit means being constructed and arranged to extend with said heating zone in close proximity to and in heat exchange relationship with said fuel fired heating means;

electric heating means constructed and arranged to heat the heat transfer fluid for maintaining a desired temperature thereof;

said conduit means including an elongated portion within said tank and a scavenger coil portion including a plurality of loops extending into the heating zone some portion of which is above the fuel fired heating means; and said electric heating means being arranged to extend within said elongated portion of said conduit means;

said scavenger coil portion comprising two horizontal layers of loops each layer having a plurality of loops and means for directing the flow of said heat transfer fluid through the loops prior to flowing through the electric heating means.

13. Apparatus for heating a fluid in storage such as asphalt or similar fluids that are viscous or solid under unheated conditions and a circulating heat transfer fluid comprising:

a storage tank;

a fuel fired heating means mounted to extend horizontally a substantial distance within said tank for delivering heat to a heating zone within said tank for heating the fluid in storage;

a heat transfer fluid;

and a conduit means providing for the recirculating flow of said heat transfer fluid, said conduit means including a flow path within said storage tank for conducting the flow of the heat transfer fluid to the interior of said storage tank;

said flow path of said conduit means being constructed and arranged to extend with said heating zone in close proximity to and in heat exchange relationship with said fuel fired heating means;

electric heating means constructed and aranged to heat the heat transfer fluid for maintaining a desired temperature thereof;

pump means for circulating heat transfer fluid through said conduit means; and first control means including means sensing a flame out condition of said fuel fired heating means to turn on said electric heating means to heat the heat transfer fluid;

said electric heating means including a low density heat input portion and a high density heat input portion;

said first control means being opeative to turn on said low density heat input portion in response to a flame out condition.

14. Apparatus for heating a fluid in storage such as asphalt or similar fluids that are viscous or solid under unheated conditions and a circulating heat transfer fluid comprising:

a storage tank;

a fuel fired heating means mounted to extend horizontally a substantial distance within said tank for delivering heat to a heating zone within said tank for heating the fluid in storage;

a heat transfer fluid;

and a conduit means providing for the recirculating flow of said heat transfer fluid, said conduit means including a flow path within said storage tank for conducting the flow of the heat transfer fluid to the interior of said storage tank;

said flow path of said conduit means being constructed and arranged to extend with said heating zone in close proximity to and in heat exchange relationship with said fuel fired heating means;

electric heating means constructed and arranged to heat the heat transfer fluid for maintaining a desired temperature thereof;

pump means for circulating heat transfer fluid through said conduit means; and first control means including means sensing a flame out condition of said fuel fired heating means to turn on said electric heating means to heat the heat transfer fluid; and second control means responsive to a preset temperature condition of the tank contents to turn on said electric heating means;

said electric heating means including a low density heat input portion and a high density heat input portion and wherein said second control means turns on said low density heat input portion in response to said preset temperature condition of said tank contents.

15. Apparatus according to claim 14 wherein said second control means turns on full heat density input in proportion in response to said preset temperature condition of heat transfer oil when oil is circulating through said conduit means.

16. Apparatus for heating a fluid in storage such as asphalt or similar fluids that are viscous or solid under unheated conditions and a circulating heat transfer fluid comprising:

a storage tank;

a fuel fired heating means mounted to extend horizontally a substantial distance within said tank for delivering heat to a heating zone within said tank for heating the fluid in storage;

a heat transfer fluid;

and a conduit means providing for the recirculating flow of said heat transfer fluid, said conduit means including a flow path within said storage tank for conducting the flow of the heat transfer fluid to the interior of said storage tank;

said flow path of said conduit means being constructed and arranged to extend with said heating zone in close proximity to and in heat exchange relationship with said fuel fired heating means;

the improvement comprising electric heating means constructed and arranged to heat the heat transfer fluid for maintaining a desired temperature thereof;

said conduit means including an elongated portion within said tank and said electric heating means being arranged to extend within said elongated portion of said conduit means;

said fuel fired heating means being located near the bottom of said storage tank, so that said heating zone is comprised of a horizontally extending region near the bottom of said storage tank, said conduit means including a scavenger coil portion including a plurality of loops contained within the vertical confines of said heating zone, and said elongated portion of said conduit means containing said electric heating means also being contained within the vertical confines of said heating zone, said loops of said scavenger coil portion being located close to and above said fuel fired heating means, and said elongated portion of said conduit means containing said electric heating means being located below at least a portion of said fuel fired heating means to permit heating of said heat transfer fluid and of the liquid in storage and also to create a circulating flow of said liquid in storage to prevent congealing thereof on said scavenger coil portion.

* * * * *